US009964118B2

(12) United States Patent
Park et al.

(10) Patent No.: US 9,964,118 B2
(45) Date of Patent: May 8, 2018

(54) SIROCCO FAN AND AIR CONDITIONER HAVING SAME

(71) Applicant: LG ELECTRONICS INC., Seoul (KR)

(72) Inventors: Byung Il Park, Changwon-si (KR); Byung Soon Kim, Changwon-si (KR); Sun Jong Noh, Changwon-si (KR); Kam Gyu Lee, Changwon-si (KR); Kyong Min Kwon, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 549 days.

(21) Appl. No.: 14/352,263

(22) PCT Filed: Oct. 10, 2012

(86) PCT No.: PCT/KR2012/008213

§ 371 (c)(1),
(2) Date: Apr. 16, 2014

(87) PCT Pub. No.: WO2013/058494

PCT Pub. Date: Apr. 25, 2013

(65) Prior Publication Data

US 2015/0016979 A1 Jan. 15, 2015

(30) Foreign Application Priority Data

Oct. 17, 2011 (KR) ..... 10-2011-0106029

(51) Int. Cl.
*F04D 29/40* (2006.01)
*F04D 29/42* (2006.01)
(Continued)

(52) U.S. Cl.
CPC ..... *F04D 29/403* (2013.01); *F04D 29/283* (2013.01); *F04D 29/424* (2013.01);
(Continued)

(58) Field of Classification Search
CPC .... F04D 29/403; F04D 29/283; F04D 29/663; F04D 29/424; F25D 17/06; F24F 7/007; F05D 2250/711; F05D 2250/73
(Continued)

(56) References Cited

U.S. PATENT DOCUMENTS 5,551,836 A * 9/1996 Roth ..... F04D 29/4213 415/204
6,200,093 B1 * 3/2001 Lee ..... F04D 29/422 415/204
(Continued)

FOREIGN PATENT DOCUMENTS

CN 1754046 3/2006
FR 2 868 813 10/2005
(Continued)

OTHER PUBLICATIONS

Chinese Office Action dated Sep. 25, 2015.
(Continued)

*Primary Examiner* — Jason T Newton
(74) *Attorney, Agent, or Firm* — KED & Associates, LLP

(57) ABSTRACT

A sirocco fan is provided that may include an impeller, in which a plurality of first blades and a plurality of second blades are formed on a main plate, and a scroll housing that covers the impeller. The scroll housing may include air suction holes formed on both of first and second plates and a rounded portion formed to be convex in an opposite direction of the impeller on a scroll that connects both of the first and second plates. An interval from the main plate to the rounded portion in a direction perpendicular to a rotation central axis of the impeller may be the largest. A rapid change in direction of air flowing to the scroll from the
(Continued)

impeller may be minimized, and collision of air with the scroll may be lessened, reducing a flow loss and enhancing efficiency.

12 Claims, 10 Drawing Sheets

(51) Int. Cl.
*F04D 29/66* (2006.01)
*F24F 7/007* (2006.01)
*F25D 17/06* (2006.01)
*F04D 29/28* (2006.01)

(52) U.S. Cl.
CPC ..... *F04D 29/663* (2013.01); *F24F 7/007* (2013.01); *F25D 17/06* (2013.01); *F05D 2250/711* (2013.01); *F05D 2250/73* (2013.01)

(58) Field of Classification Search
USPC ..... 415/102
See application file for complete search history.

(56) References Cited

U.S. PATENT DOCUMENTS 6,677,564 B1 * 1/2004 Sohn ..... F04D 25/166 126/299 R
6,953,319 B2 * 10/2005 Sohn ..... F04D 29/4226 415/119
7,144,219 B2 * 12/2006 Hancock ..... F04D 29/422 415/119
7,473,070 B2 * 1/2009 Song ..... H05B 6/6423 415/119
7,549,842 B2 * 6/2009 Hanson ..... B60H 1/00471 415/204
7,568,338 B2 * 8/2009 Noelle ..... F01D 9/042 415/199.1
7,591,633 B2 * 9/2009 Hancock ..... F04D 29/4226 415/206
2004/0253101 A1 * 12/2004 Hancock ..... F04D 17/02 415/213.1
2009/0232648 A1 * 9/2009 Wu ..... F04D 29/4226 415/204
2012/0121403 A1 * 5/2012 Clemons ..... F01D 17/162 415/208.1

FOREIGN PATENT DOCUMENTS

JP 2007-239538 9/2007
JP 2007239538 A * 9/2007 ..... F04D 29/4226
KR 10-2000-0040209 7/2000
KR 10-0269375 B1 1/2001
KR 10-2009-0088440 A 8/2009
KR 10-1241730 B1 3/2013
WO WO 2007/075532 A2 7/2007

OTHER PUBLICATIONS

European Search Report dated Jan. 16, 2013.
International Search Report dated Feb. 22, 2013 issued in Application No. PCT/KR2012/008213.

* cited by examiner (a)

(b)

PRIOR ART

PRIOR ART

PRIOR ART

PRIOR ART

PRIOR ART

SIROCCO FAN AND AIR CONDITIONER HAVING SAME

BACKGROUND OF THE INVENTION

CROSS-REFERENCE TO RELATED PATENT APPLICATIONS

This application is a U.S. National Stage Application under 35 U.S.C. § 371 of PCT Application No. PCT/KR2012/008213, filed Oct. 10, 2012, which claims priority to Korean Patent Application No. 10-2011-0106029, filed Oct. 17, 2011.

Field of the Invention

The present invention relates to a sirocco fan and an air-conditioner having the same and, more particularly, to a sirocco fan in which air is sucked through left and right faces of a scroll housing, and an air-conditioner having the same.

Related Art

In general, a sirocco fan, which has a plurality of short front curved blades, generates less noise, so it is commonly used in ventilation apparatuses or air-conditioners.

The sirocco fan may include an impeller and a scroll housing covering the impeller, and the scroll housing may include an air suction hole formed on at least one of left and right sides of the impeller to guide air suction.

PRIOR ART DOCUMENT

Patent document: KR 10-2006-0076647 A (Jul. 4, 2006)

DISCLOSURE OF INVENTION

Technical Problem

The related art sirocco fan has a problem in which when air flows toward a fan housing from an impeller, the air flow direction may be rapidly changed, and since air greatly collides with an inner face of the fan housing, strong noise is generated.

Technical Solution

According to an aspect of the present invention, there is provided a sirocco fan including: an impeller in which a plurality of first blades are formed on one of left and right faces of a main plate and a plurality of second blades are formed on the other of the left and right faces of the main plate; and a scroll housing covering the impeller, wherein the scroll housing includes air suction holes formed on both of left and right plates and a rounded portion formed to be convex in the opposite direction of the impeller on a scroll unit connecting both of the left and right plates, and an interval from the main plate to the rounded portion in a direction perpendicular to a rotation central axis of the impeller is the largest.

The rounded portion may be formed between a cutoff and a position of a reference angle.

The rounded portion may have a radius of curvature which is not uniform from the cutoff to the position of the reference angle.

The radius of curvature at the position of 180°, starting from the position of the reference angle, of the rounded portion may be larger than that of the position of 270° starting from the position of the reference angle.

The rounded portion may have a radius of curvature increasing from the position of 270°, starting from the position of the reference angle, toward the position of the reference angle.

The entirety from a left plate connection portion connected to the left plate of the scroll unit to a right plate connection portion connected to the right plate may be formed to be rounded, and the interval between a central portion between the left plate connection portion and the right plate connection portion and the main plate may be the largest.

A portion between the left plate connection portion connected to the left plate of the scroll unit and the right plate connection portion connected to the right plate may be formed to be rounded, and the interval between the central portion of the rounded portion and the main plate may be the largest.

Advantageous Effects

According to embodiments of the present invention, a rapid change in the direction of air flowing to the scroll unit from the impeller can be minimized, and collision of air with the scroll unit is lessened, reducing a flow loss and enhancing efficiency.

Also, the capacity occupied by the sirocco fan can be minimized, and utilization of a space near the sirocco fan can be enhanced.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE EMBODIMENTS

Embodiments of the present invention will be described in detail with reference to the accompanying drawings.

Figure 1:
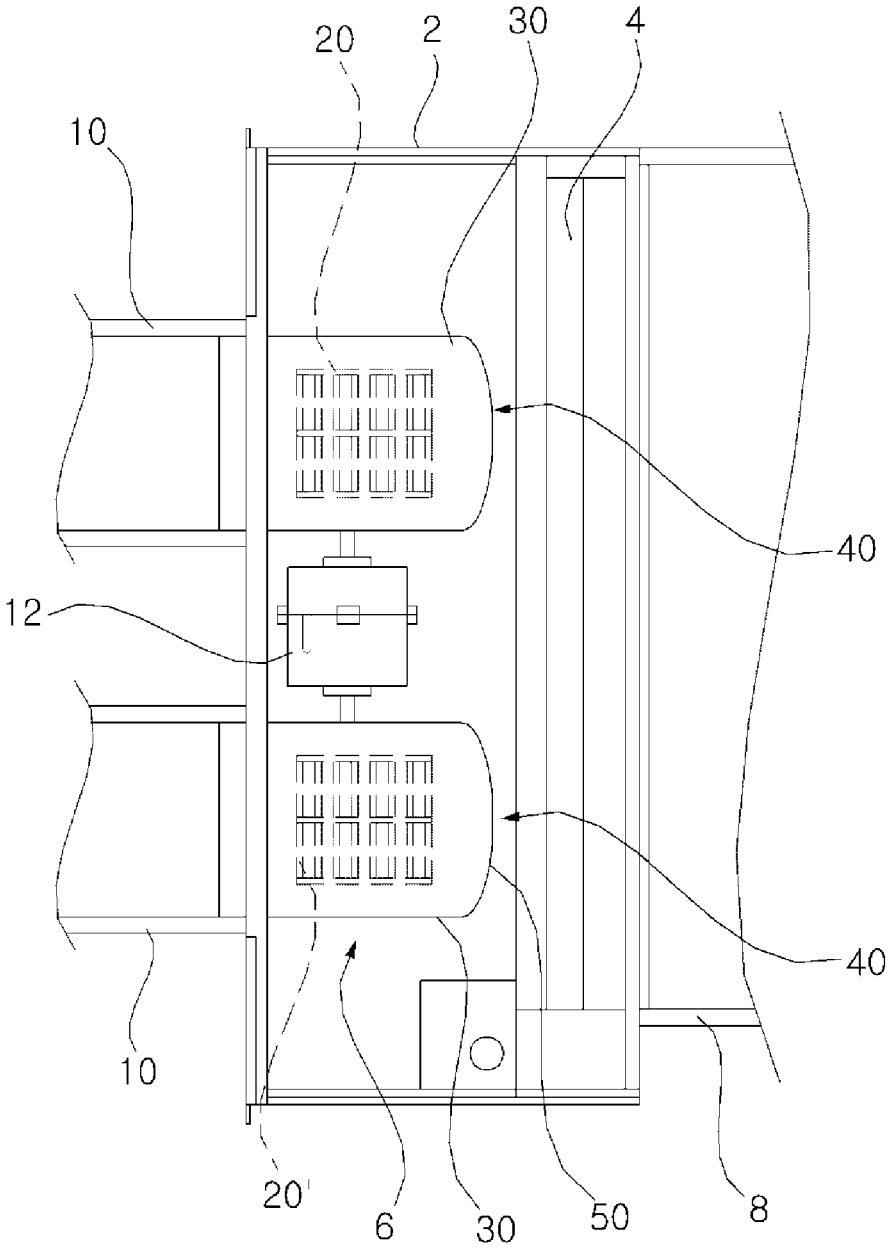
FIG. 1 is a plan view showing the interior of an air-conditioner having a sirocco fan according to an embodiment of the present invention.
Figure 2:
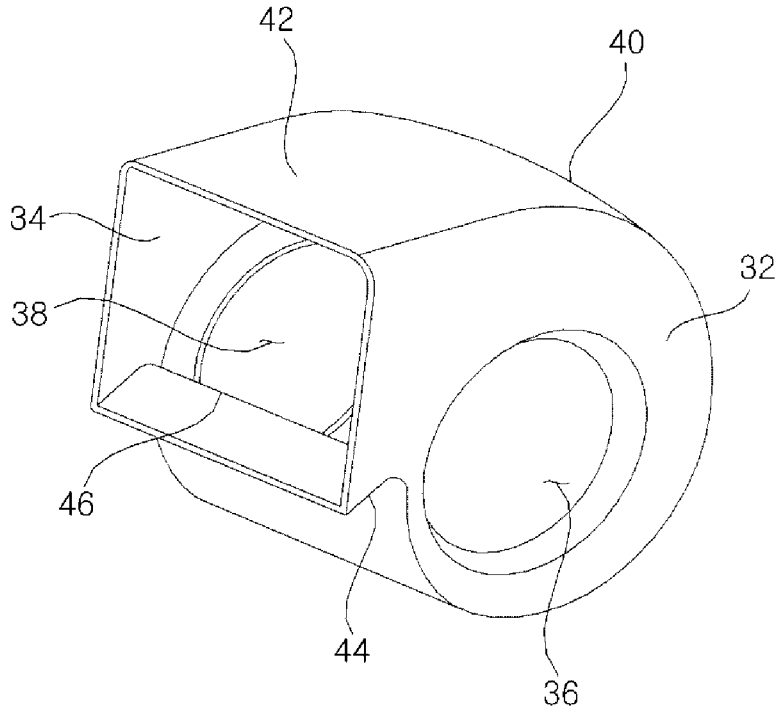
FIG. 2 is a perspective view of a scroll housing illustrated in FIG. 1.
Figure 3:
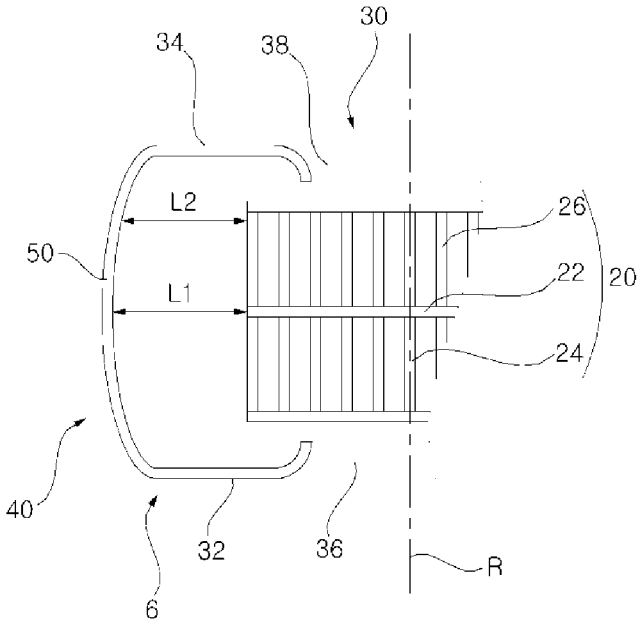
FIG. 3(*a*) is a partially cut sectional view of the sirocco fan according to an embodiment of the present invention, and FIG. 3(*b*) is a partially cut sectional view fan of the related art sirocco fan.
Figure 3:
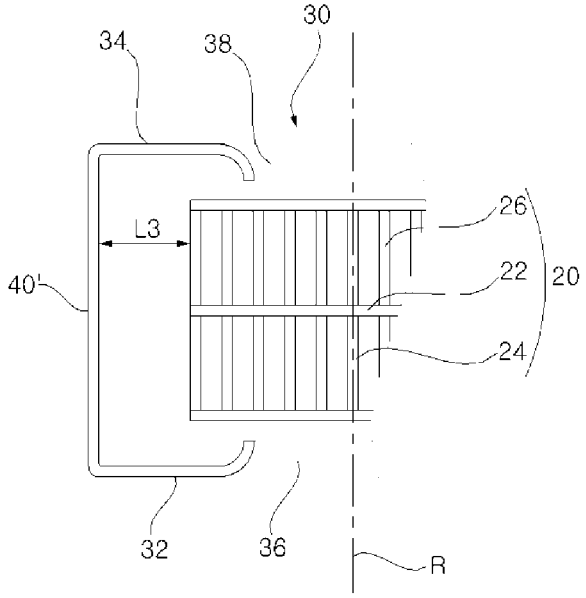

FIG. 1 is a plan view showing the interior of an air-conditioner having a sirocco fan according to an embodiment of the present invention. FIG. 2 is a perspective view of a scroll housing illustrated in FIG. 1. FIG. 3 is a partially cut sectional view showing the comparison between the sirocco fan according to an embodiment of the present invention and the related art sirocco fan.

An air-conditioner may include a cabinet 2, a heat exchanger 4 installed within the cabinet 2, and a sirocco fan 6 for sucking air into the heat exchanger 4 and blowing (or ventilating) air which has passed through the heat exchanger 4.

The air-conditioner may be configured as a duct type air-conditioner. A suction duct 8 allowing air of a room to be air-conditioned to be sucked to the heat exchanger 4 therethrough may be connected to the cabinet 2. A discharge duct 10 guiding air blown from the sirocco fan 6 to the room to be air-conditioned may be connected to the sirocco fan 6. The cabinet may form an external appearance of the duct type air-conditioner and may be formed to extend in a horizontal direction and short in a forward/backward direction.

The heat exchanger 4 may be formed to extend in a direction perpendicular to a direction in which air flows, and may be installed vertically or slopingly within the cabinet 2.

The sirocco fan 6 may include a motor 12, an impeller 20 rotatably connected to the motor 12, and a scroll housing 30 covering the impeller 20.

The sirocco fan 6 may be configured such that one motor 12 rotates a plurality of impellers 20, the motor 12 is placed at the center, and the impellers 20 are connected to left and right sides of the motor 12, and the scroll housing 30 may encompass each of the impellers 20.

The motor 12 may be configured as a dual-shaft motor having a rotational shaft 22 is provided from both of left and right directions. One rotational shaft may be connected to a rotation center of the impeller 20 placed at the left side, and the other rotational shaft may be connected to a rotation center of the impeller 20 placed at the right side.

The impeller 20 may include a plurality of first blades 24 formed on one of left and right faces of a main plate 22 and a plurality of second blades 26 formed on the other of the left and right faces of the main plate 22.

In the impeller 20, the main plate 22 and the plurality of first blades 24 may form a first impeller unit, and the main plate 22 and the plurality of second blades 26 may form a second impeller unit.

FIG. 3(*a*) is a partially cut sectional view of the sirocco fan according to an embodiment of the present invention, and FIG. 3(*b*) is a partially cut sectional view of the related art sirocco fan.

The scroll housing 30 may include air suction holes 36 and 38 formed at both of left and right plates 32 and 34.

The left plate 32 and the right plate 34 may be disposed to be parallel. The air suction hole 36 of the left plate 32 and the air suction hole 38 of the right plate 34 may be formed to face each other.

The scroll housing 30 may include a housing unit surrounding the circumference of the impeller 20. The housing unit may include a scroll unit 40 connecting the left and right plates 32 and 34 and formed to have a scroll shape. The scroll unit 40 may be formed to be rounded in a direction in which the impeller 20 rotates.

The scroll housing 30 may include a plate body unit 42 extending from the scroll unit 40 in an air discharge direction and connecting the left and right plates 32 and 34.

The scroll housing 30 may include a discharge guide 44. The discharge guide 44 may become distant from scroll unit 40 toward the air discharge direction from the scroll unit 40 and connects the left and right plates 32 and 34.

The scroll housing 30 may further an air discharge hole 46 formed between the left and right plats 32 and 34, the plate body unit 42, and the discharge guide 44.

As shown in FIG. 3(*a*), the sirocco fan according to an embodiment of the present invention may have a rounded portion 50 which is convex in the opposite direction of the impeller 20. As shown in FIG. 3(*a*), the rounded portion 50 may be formed to be convex in a direction perpendicular to a rotation central axis of the scroll housing 30. The rounded portion 50 may be formed such that an interval L1 between the rounded portion 50 and the main plate 22 in the direction perpendicular to the rotation central axis (R) of the impeller 20 is the largest. In the rounded portion 50, the interval from the main plate 22 to the rounded portion 50 in the direction perpendicular to the rotation central axis (R) of the impeller 20 is the largest. In the rounded portion 50, the interval L1 between the central portion and the main plate 22 in the direction perpendicular to the rotation central axis (R) of the impeller 20 may be larger than an interval L2 between other portions than the central portion and the main plate 22 in the direction perpendicular to the rotation central axis (R) of the impeller 20.

Meanwhile, in the related art sirocco fan, as shown in FIG. 3(*b*), an interval L3 between a scroll unit 40' and the impeller 20 in a direction in which the scroll unit 40' is perpendicular to the rotation central axis (R) of the impeller 20 is uniform.

The rounded portion 50 may be formed between a left plate connection portion of the scroll unit 40 to the left plate 32 and a right plate connection region of the scroll unit 40 connected to the right plate 32. In the scroll unit 40, the entirety from the left plate connection portion to the right plate connection region is rounded and the interval L1 between the central portion between the left plate connection portion and the right plate connection region and the main plate 22 is formed to be the largest. In the scroll unit 40, as a portion between the left plate connection portion and the right plate connection region is formed to be rounded, the interval L1 between the central portion of the rounded portion 50 and the main plate 22 may be formed to be the largest.

In the scroll housing 30, when the portions of both of the left and right plates 32 and 34 connected to the scroll unit 40 is as large as the outermost position of the rounded portion 50, the capacity occupied by the scroll housing 30 is increased. Meanwhile, when the portions of both of the left and right plates 32 and 34 connected to the scroll unit 40 is smaller than the outermost position of the rounded portion 50, the capacity occupied by the scroll housing 30 is reduced.

In an embodiment of the present invention, the capacity of the scroll housing 30 can be minimized while minimizing a flow loss and noise of the sirocco fan 6, and when the sirocco fan 6 is installed in an air-conditioner, utilization of space near the sirocco fan 6 can be enhanced and the air-conditioner can be configured to become compact to its maximum level.

Figure 4:
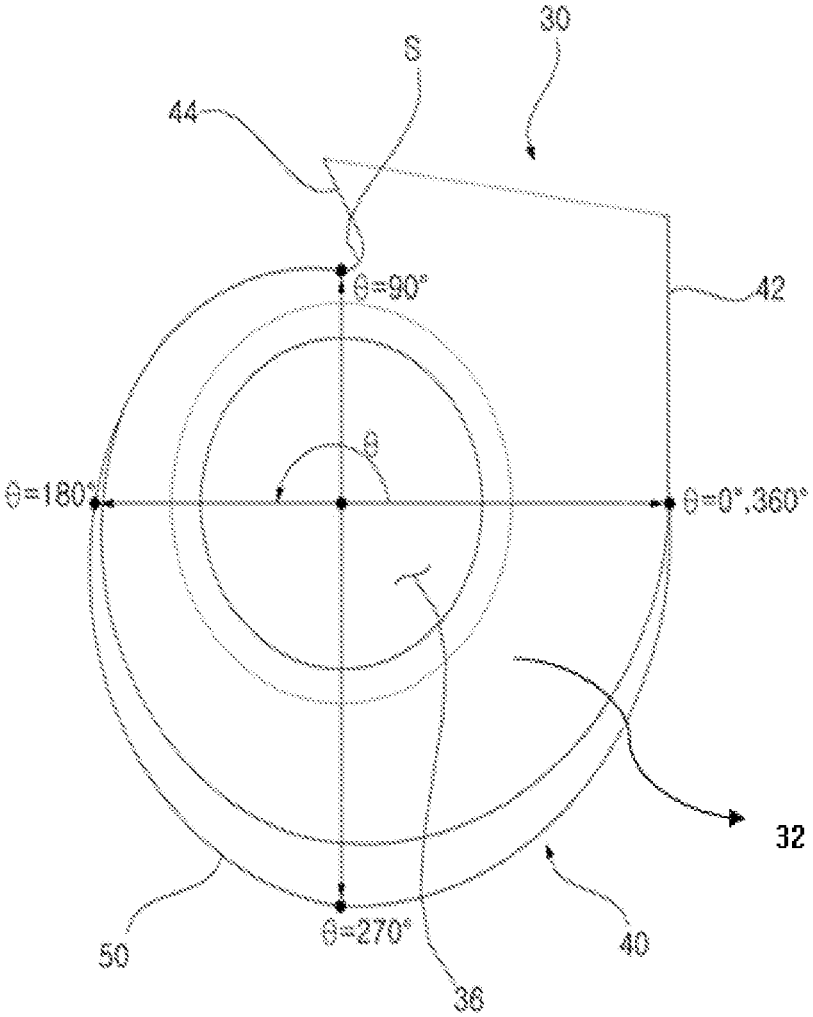
FIG. 4 is a side view of the sirocco fan according to an embodiment of the present invention.
Figure 5:
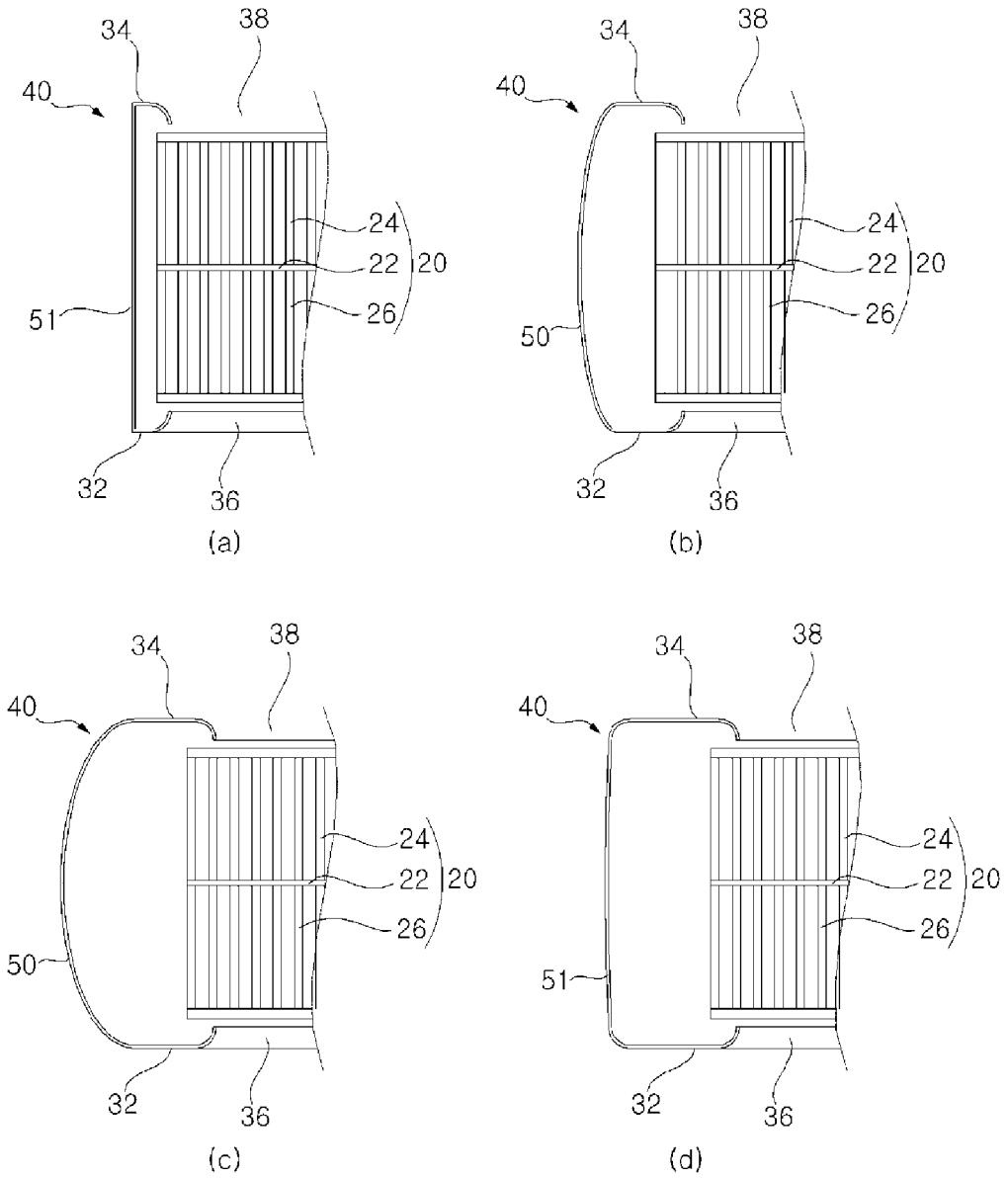
FIG. 5 is a partially cut sectional view of the sirocco fan according to an embodiment of the present invention.

FIG. 4 is a side view of the sirocco fan according to an embodiment of the present invention. FIG. 5 is a partially cut sectional view of the sirocco fan according to an embodiment of the present invention.

FIG. 5(*a*) is a partially cut sectional view at a position of 90° from a reference angle, FIG. 5(*b*) is a partially cut sectional view at a position of 180° from the reference angle, FIG. 5(*c*) is a partially cut sectional view at a position of 270° from the reference angle, and FIG. 5(*d*) is a partially cut sectional view at a position of the reference angle.

As shown in FIGS. 4 an 5, the rounded portion 50 may be formed from a cutoff (S) to position of the reference angle (θ=0° or 360°).

Here, the reference angle (θ=0° or 360°) may be an angle determined by using a position at which a curved face of the scroll unit 40 ends as a reference. The cutoff (S) may be placed at a position substantially within 90° in the rotation direction of the impeller 20.

The rounded portion 50 may be formed to be rounded in a direction perpendicular to the rotation central axis (R) of the impeller 20 over the entirety from the cutoff (S) to the position of the reference angle (θ=0° or 360°).

The rounded portion 50 may be formed to be rounded in a direction perpendicular to the rotation central axis (R) of the impeller 20 only at a portion from the cutoff (S) to the position of the reference angle (θ=0° or 360°).

The rounded portion 50 may be formed to have a non-uniform radius of curvature from the cutoff (S) to the position of the reference angle (θ=0° or 360°).

In the scroll unit 40, the rounded portion 50 may be formed at a region in the rotation direction of the impeller 20, and a flat portion 51, which is not rounded, may be formed in the other remaining regions.

In the scroll unit 40, a region close to the cutoff (S) may be formed as the flat portion 51, and a position of the reference angle (θ=0° or 360°) may be formed as the flat portion 51.

In the rounded portion 50, the radius of curvature of the position of 180° from the position of the reference angle (θ=0° or 360°) may be larger than that of the position of 270° from the position of the reference angle (θ=0° or 360°).

The rounded region 50 may be formed such that the radius of curvature is increased from the position of 270° starting from the position of the reference angle (θ=0° or 360° toward the position of the reference angle (θ=0° or 360°).

In the scroll housing 30, the space between the vicinity of the position of 180° starting from the reference angle (θ=0° or 360°) and the cutoff (S) may be a flow suction region, and the vicinity of the position of 270° starting from the position of the reference angle (θ=0° or 360°) may be a flow discharge region, and here, the direction of a flow of the flow discharge region is gently changed when changed along the scroll housing 30, making the velocity of flow uniform.

The impeller 20 is rotated based on the rotation central axis within the scroll housing 30 when the motor 12 is driven. When the impeller 20 is rotated, air positioned at the left side of the scroll housing 30 is sucked to the left side within the scroll housing 30 through the air suction hole 36 of the left plate 32. When the impeller 20 is rotated, air positioned at the right side of the scroll housing 30 is sucked to the right side within the scroll housing 30 through the air suction hole 38 of the right plate 34.

The air sucked to the left side within the scroll housing 30 flows toward the scroll unit 40 by the plurality of first blades 24. The air sucked to the right side within the scroll housing 30 flows toward the scroll unit 40 by the plurality of second blades 26. The air flowing by the plurality of first blades 24 and the air flowing by the plurality of second blades 26 are mixed within the scroll housing 30, a flow direction thereof between the rounded portion 50 and the impeller 20 is changed, a dynamic pressure is converted into a static pressure, and thereafter, the air flows toward the air discharge hole 46 and then discharged through the air discharge hole 44.

Figure 6:
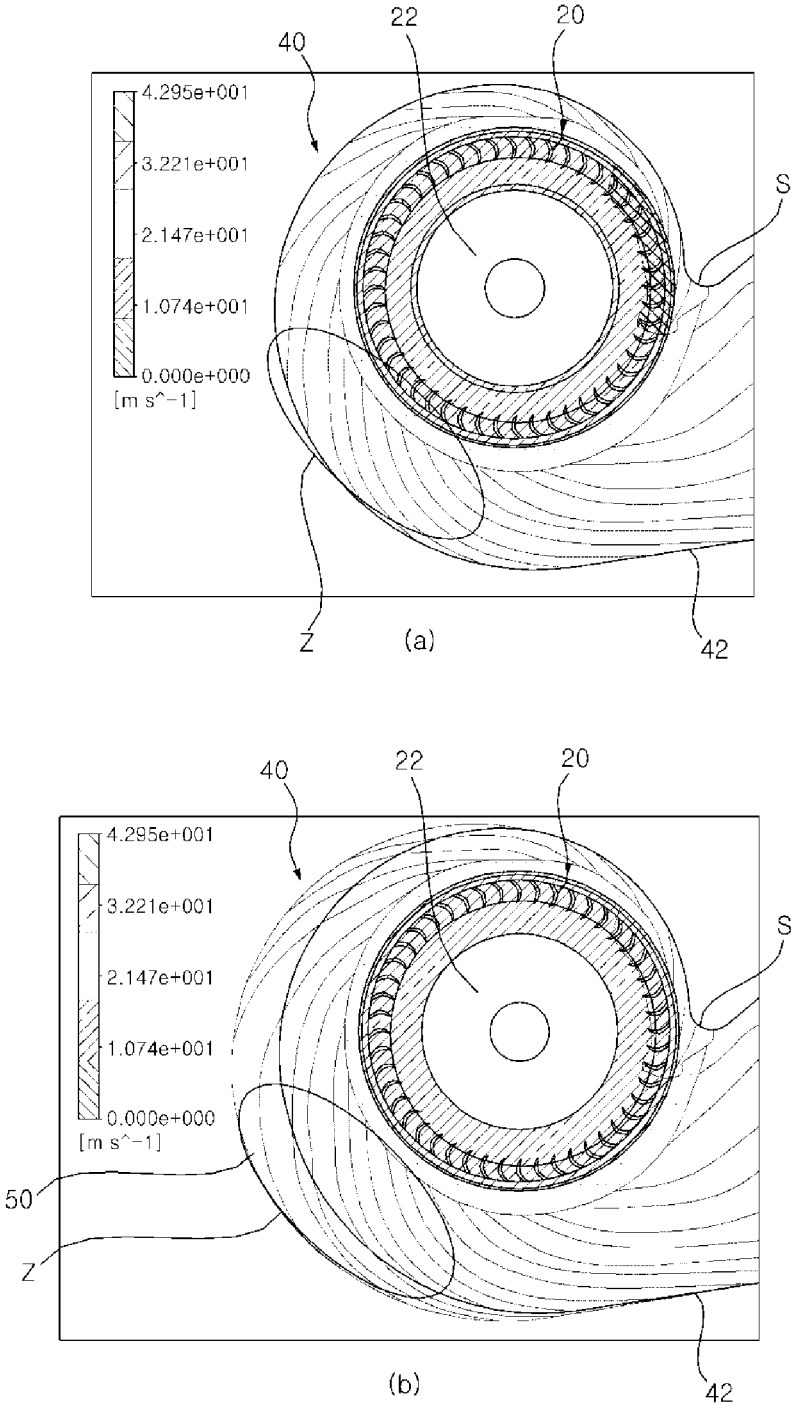
FIG. 6(*a*) is a view showing a velocity vector of the related art sirocco fan, and FIG. 6(*b*) is a view showing a velocity vector of the sirocco fan according to an embodiment of the present invention.

FIG. 6 is a view showing the comparison between a velocity vector of the sirocco fan according to an embodiment of the present invention and that of the related art sirocco fan. FIG. 6(*a*) illustrates a velocity vector of the related art sirocco fan and FIG. 6(*b*) illustrates a velocity vector of the sirocco fan according to an embodiment of the present invention.

As shown in FIG. 6(*a*), in the related art sirocco fan, a flow discharged from the impeller 20 is rapidly changed in direction at a flow discharge portion Z along the scroll housing 30 and the flow severely collides with the scroll housing 30. The severe collision of the flow with the scroll housing 30 and the rapid change in the flow direction may degrade efficiency due to the flow loss and cause noise.

Meanwhile, as shown in FIG. 6(*b*), in the sirocco fan according to an embodiment of the present invention, when the flow discharged from the impeller 20 is changed in direction at the flow discharge portion Z along the scroll housing 30, the direction is gently changed in comparison to the related art sirocco fan, the collision of the flow with the scroll housing 30 is reduced in comparison to the related art sirocco fan, and the efficiency can be enhanced.

Figure 7:
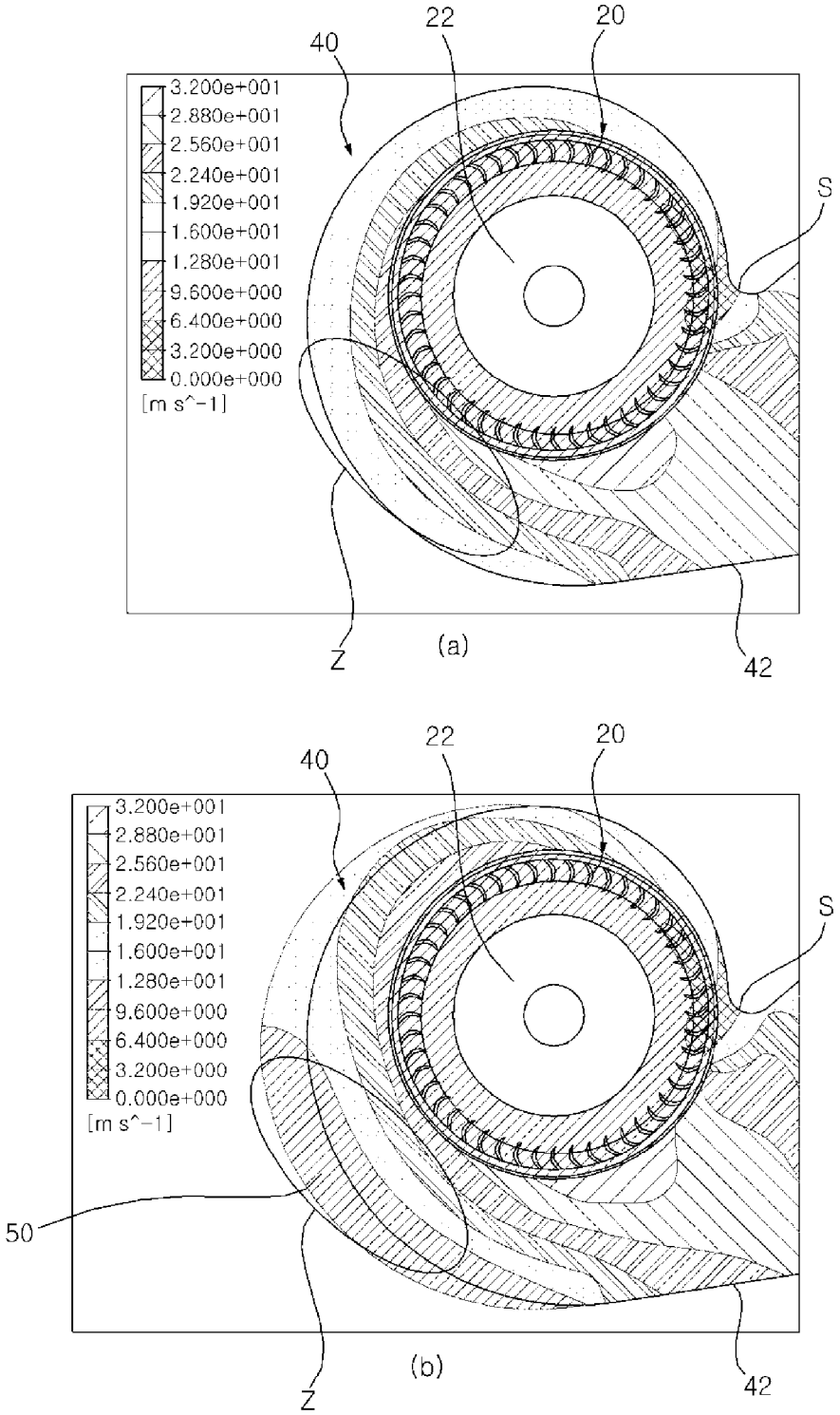
FIG. 7(*a*) is a view showing a velocity distribution of the related art sirocco fan, and FIG. 7(*b*) is a view showing a velocity distribution of the sirocco fan according to an embodiment of the present invention.

FIG. 7 is a view showing the comparison between a velocity distribution of the sirocco fan according to an embodiment of the present invention and that of the related art sirocco fan. FIG. 7(*a*) illustrates the velocity distribution of the related art sirocco fan, and FIG. 7(*b*) illustrates the velocity distribution of the sirocco fan according to an embodiment of the present invention.

As shown in FIG. 7(*a*), in the related art sirocco fan, as the flow discharged from the impeller 20 flows at a fast speed at the flow discharge portion Z along the scroll housing 30, the velocity slope is large, and such a fast speed and large velocity slope may degrade the efficiency and cause noise.

Meanwhile, as shown in FIG. 7(*b*), in the sirocco fan according to an embodiment of the present invention, when the flow discharged from the impeller 20 flows at a fast speed at the flow discharge portion Z along the scroll housing 30, the flow has a lower speed and gentle velocity slope in comparison to the related art sirocco fan, and since the flow has a lower speed and gentle velocity slope in comparison to the related art sirocco fan, noise can be reduced.

Figure 8:
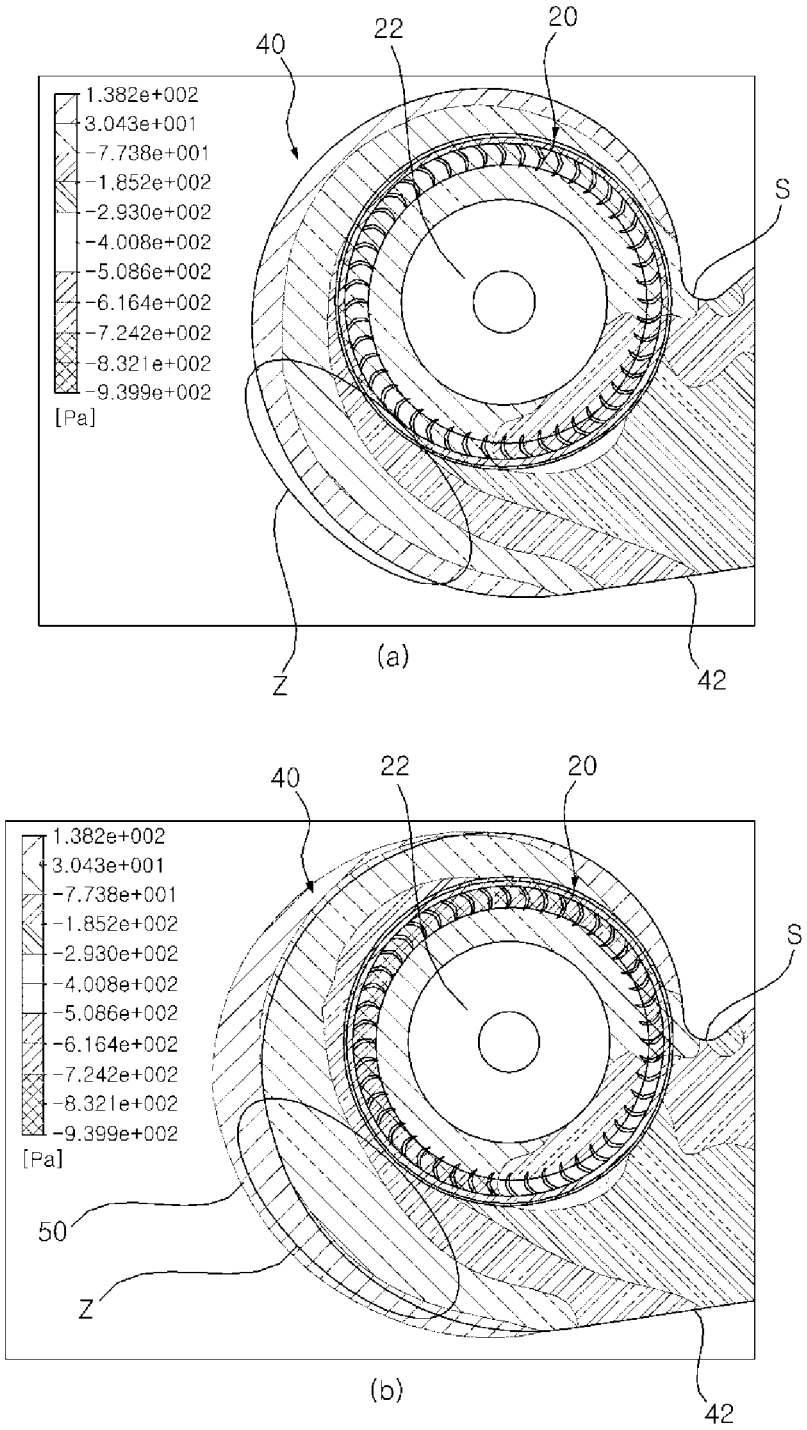
FIG. 8(*a*) is a view showing a pressure distribution of the related art sirocco fan, and FIG. 8(*b*) is a view showing a pressure distribution of the sirocco fan according to an embodiment of the present invention.

FIG. 8 is a view showing the comparison between a pressure distribution of the sirocco fan according to an embodiment of the present invention and that of the related art sirocco fan. FIG. 8(*a*) illustrates the pressure distribution of the related art sirocco fan, and FIG. 8(*b*) illustrates the pressure distribution of the sirocco fan according to an embodiment of the present invention.

As shown in FIG. 8(*a*), in the related art sirocco fan, when the flow discharged from the impeller 20 flows at the flow discharge portion Z, a wall face of the scroll housing 30 has a high pressure, and since the pressure of the flow is not recovered, the pressure is low, and the degree of converting the dynamic pressure into the static pressure within the scroll housing 30 is weak, having a low pressure performance.

Meanwhile, as shown in FIG. 8(*b*), in the sirocco fan according to an embodiment of the present invention, when the flow discharged from the impeller 20 flows at the flow discharge portion Z, it generally has pressure characteristics within a wide range along the scroll housing 30, the pressure of the scroll housing 30 is recovered overall, and the conversion from the dynamic pressure to the static pressure within the scroll housing 30 is excellent, increasing the pressure performance, in comparison to the related art sirocco fan.

Figure 9:
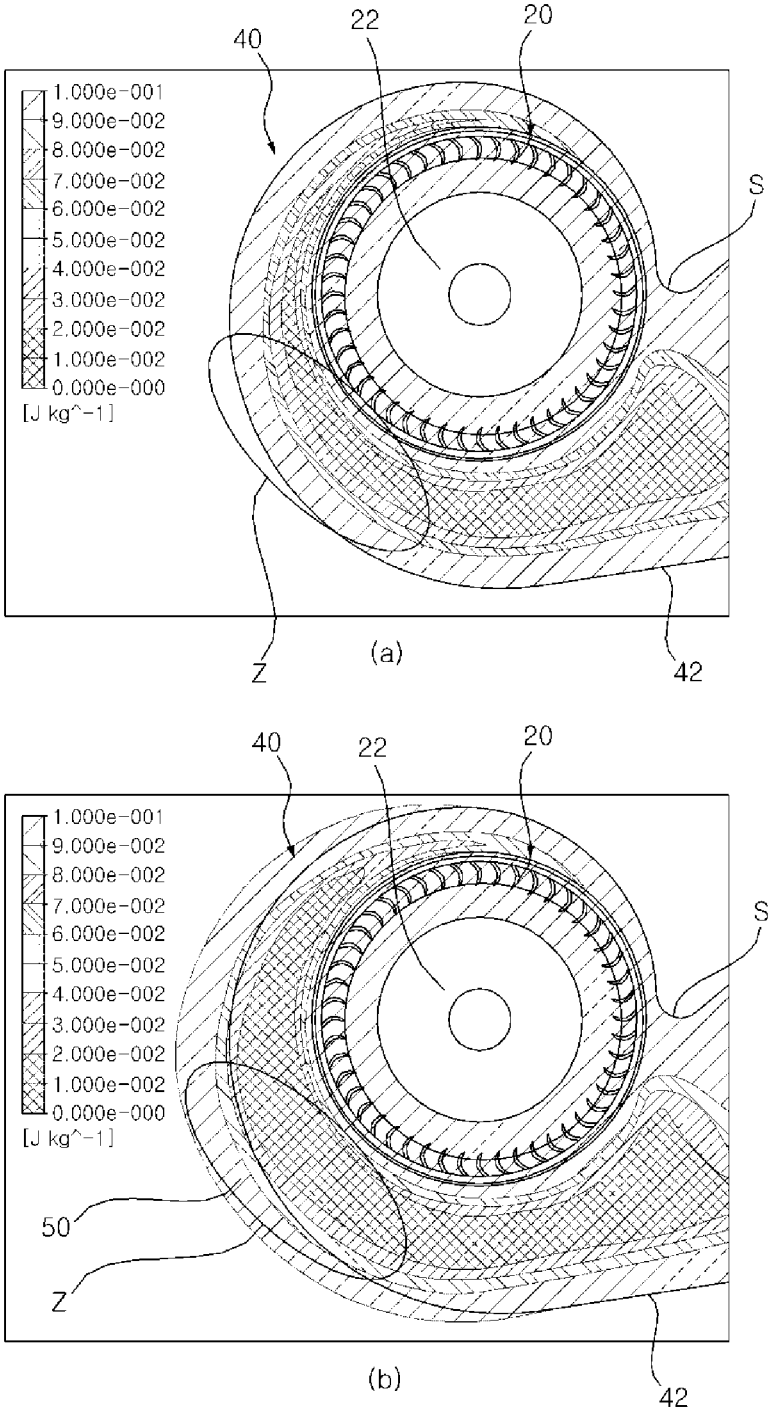
FIG. 9(*a*) is a view showing an intensity of turbulent flow of the related art sirocco fan, and FIG. 9(*b*) is a view showing an intensity of turbulent flow of the sirocco fan according to an embodiment of the present invention.

FIG. 9 is a view showing the comparison between an intensity of turbulent flow of the sirocco fan according to an embodiment of the present invention and that of the related art sirocco fan. FIG. 9(*a*) illustrates the intensity of turbulent flow of the related art sirocco fan, and FIG. 9(*b*) illustrates the intensity of turbulent flow of the sirocco fan according to an embodiment of the present invention.

As shown in FIG. 9(*a*), in the related art sirocco fan, there is an area in which the intensity of turbulent flow of the flow discharged from the impeller 20 is high at the flow discharge portion Z, and such a high intensity of turbulent flow may cause noise.

Meanwhile, as shown in FIG. 9(*b*), in the sirocco fan according to an embodiment of the present invention, there is an area in which the intensity of turbulent flow of the flow discharged from the impeller 20 is low within a wide range at the flow discharge portion Z in comparison to the related art sirocco fan, and noise can be reduced due to the low intensity of turbulent flow.

Figure 10:
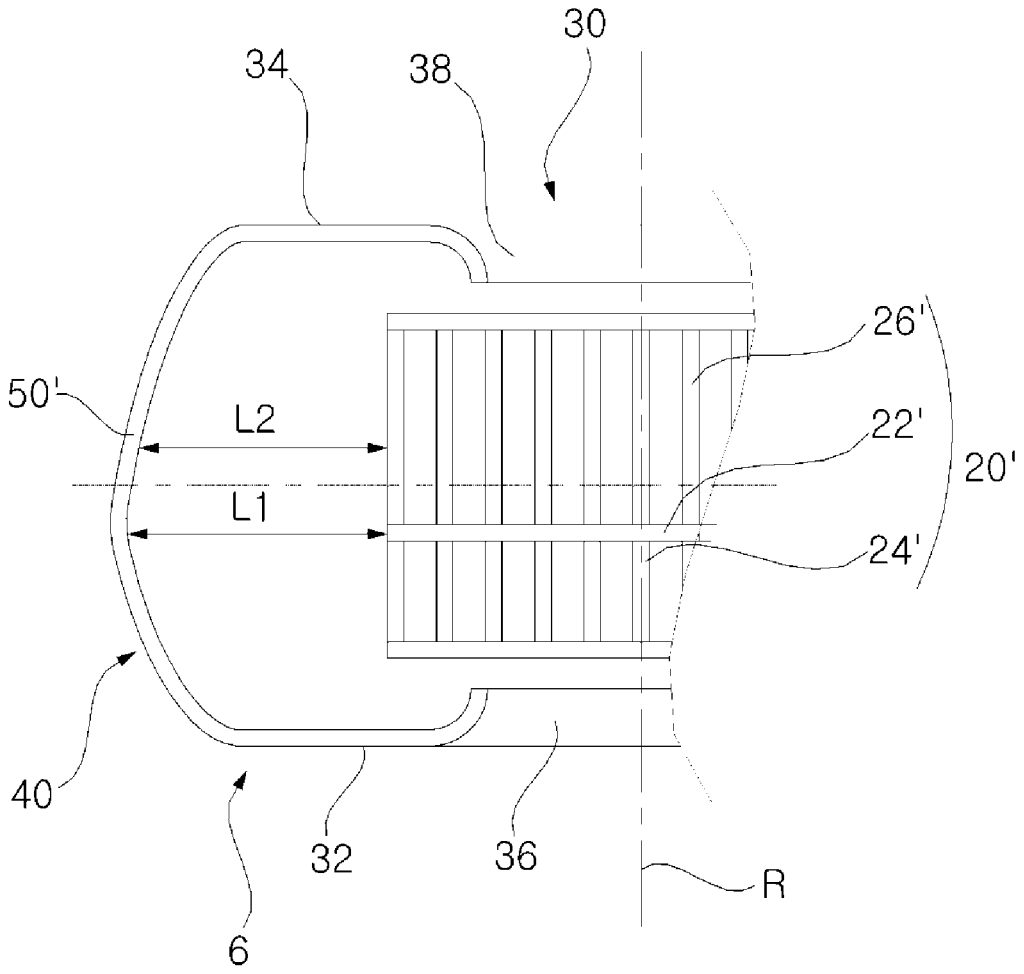
FIG. 10 is a partially cut sectional view of the sirocco fan according to another embodiment of the present invention.

FIG. 10 is a partially cut sectional view of the sirocco fan according to another embodiment of the present invention.

As shown in FIG. 10, in the sirocco fan according to the present embodiment may, an impeller 20' may include a main plate 22', a plurality of first blades 24' and a plurality of second blades 26'. The plurality of first blades 24' may have a length different from that of the plurality of second blades 26'. The main plate 22' may be positioned to be closer to one of the left plate 32 and the right plate 34. The scroll unit 40 may have a rounded portion convex in the opposite direction of the impeller 20' likewise as in an embodiment of the present invention, and the interval L1 between the rounded portion 50' and the main plate 22' in a direction perpendicular to the rotation central axis R of the impeller 20' may be the largest.

In the rounded portion 50', based on the portions facing the main plate 22', portions facing the blades 26' having a larger length and the portions facing the blades 24' having a smaller length may be continued. In the rounded portion 50', the length of the radius of curvature of the portion facing the blades 26' having a larger length may be larger than that of the portion facing the blades 24' having a smaller length.

Namely, in the rounded portion 50', when the main plate 22' is positioned to be closer to any one of the left plate 32 and the right plate 34 of the scroll housing 40, one side among the left and right sides may be formed to be more convex than that of the other side based on the dead center of the scroll unit 40.

In the present embodiment, other configurations and operations than the impeller 20' and the rounded portion 50' are the same or similar to those of the former embodiment of the present invention, so the same reference numerals are used and a detailed description thereof are omitted.

What is claimed is:

1. A sirocco fan comprising:

an impeller in which a plurality of first blades is formed on one of first and second faces of a main plate and a plurality of second blades is formed on the other of the first and second faces of the main plate; and a scroll housing that covers the impeller, and including a first plate and a second plate, wherein the scroll housing includes air suction holes formed on both of the first and second plates, and a rounded portion formed to be convex in an opposite direction of the impeller, wherein the rounded portion of the scroll housing connects both of the first and second plates, wherein an interval from the main plate to the rounded portion in a direction perpendicular to a rotation central axis of the impeller is the largest, wherein a radius of the curvature of the rounded portion is a radius of the rounded portion that connects both of the first and second plates so as to be convex with respect to a hypothetical line parallel to the rotation central axis of the impeller at a position of a predetermined degree of an angle from a position of a reference angle, wherein the reference angle is at an end of a curved face of the first plate and an end of a curved face of the second plate, wherein a radius of curvature of the rounded portion at a position of 180° from a position of a reference angle is larger than a radius of curvature of the rounded portion at a position of 270° from the position of the reference angle, and wherein a radius of curvature of the rounded portion increases from the position of 270° from the position of the reference angle toward the position of the reference angle.

2. The sirocco fan of claim 1, wherein the rounded portion is formed between a cutoff and the position of the reference angle.

3. The sirocco fan of claim 1, wherein the rounded portion has the radius of curvature which is not uniform from a cutoff to the position of the reference angle.

4. The sirocco fan of claim 1, wherein an entirety from a first plate connection portion connected to the first plate to a second plate connection portion connected to the second plate is formed to be rounded, and wherein an interval between a central portion between the first plate connection portion and the second plate connection portion and the main plate is the largest.

5. The sirocco fan of claim 1, wherein a portion between a second plate connection portion connected to the first plate and a second plate connection portion connected to the second plate is formed to be rounded, and wherein an interval between a central portion of the rounded portion and the main plate is the largest.

6. An air-conditioner including the sirocco fan of claim 1.

7. The sirocco fan of claim 1, further including a motor rotatably coupled to the impeller.

8. The sirocco fan of claim 1, wherein the first plate and the second plate are provided parallel to each other, and wherein the suction holes formed on the first plate and the second plate face each other.

9. The sirocco fan of claim 1, wherein the scroll housing further includes a plate body that extends from the rounded portion at the position of the reference angle in an air discharge direction, and wherein the plate body is connected to the first plate and the second plate.

10. The sirocco fan of claim 9, wherein the scroll housing further includes a discharge guide that extends from a position of 90° of the rounded portion from the position of the reference angle in the air discharge direction, and wherein the discharge guide is connected to the first plate and the second plate.

11. The sirocco fan of claim 10, wherein the discharge guide gradually extends away from the plate body in the air discharge direction.

12. The sirocco fan of claim 10, wherein the scroll housing includes an air discharge hole formed between the first plate, the second plate, the plate body, and the discharge guide.

* * * * *